US005941568A

United States Patent [19]

White, II

[11] Patent Number: 5,941,568

[45] Date of Patent: *Aug. 24, 1999

[54] SKATE GUARD

[75] Inventor: Harry Harold White, II, Barrie, Canada

[73] Assignee: Marc Avon Enterprises, Inc., Windsor, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/892,725

[22] Filed: Jul. 15, 1997

[30] Foreign Application Priority Data

Jul. 18, 1996 [CA] Canada ..... 2181564

[51] Int. Cl.[6] ..... A63C 3/12

[52] U.S. Cl. ..... 280/825

[58] Field of Search ..... 280/841, 11–12, 280/825

[56] References Cited

U.S. PATENT DOCUMENTS

| | | | |
|---|---|---|---|
| 1,788,433 | 1/1931 | Johnson | 280/875 |
| 1,982,524 | 11/1934 | Kutchera | 36/7.5 |
| 2,137,637 | 11/1938 | Jorgensen | 280/11.38 |
| 2,154,735 | 4/1939 | Driscoll et al. | 280/11.38 |
| 2,181,779 | 11/1939 | Barnard | 280/11.38 |
| 3,583,720 | 6/1971 | Fowlkes | 280/825 |
| 4,021,054 | 5/1977 | Csutor | 280/11.37 |
| 4,252,345 | 2/1981 | Cabral | 280/825 |
| 4,365,878 | 12/1982 | Holl et al. | 280/825 |
| 4,382,615 | 5/1983 | Gronborg et al. | 280/825 |
| 4,392,674 | 7/1983 | Evon | 280/825 |
| 5,580,094 | 12/1996 | Ryehlman et al. | 280/825 |
| 5,765,870 | 6/1998 | Riley | 280/825 |

*Primary Examiner*—Richard M. Camby

*Attorney, Agent, or Firm*—Laubscher & Laubscher; R. J. Lasker

[57] ABSTRACT

A skate guard has a blade protector or guide bar (11, 111) and a support block (12, 112) slidable along the guide bar (11, 112) in a compatible longitudinal guide channel or channels provided in the guide bar. The toe end of the bar (11, 111) is provided, with a downwardly and rearwards facing clamping surface (28, 128) adapted to engage the upwardly and forwards facing edge (29) of a blade, while the block (12, 112) includes a downwardly and forwards facing clamping surface (36) which wedgingly urges the heel portion of the blade in the direction toward the guide bar. The force of a spring or springs (38, 141*a*, 141*b*) urging the block (12, 112) towards the toe portion maintains a firm engagement between generally flat and upwardly facing support portions (18, 118) and (21, 121) with the underside (19, 22, 119, 122) of the toe and heel plates, (20, 23, 120, 123) of the skate blade respectively. In a preferred embodiment, the support portions (118, 121) are provided with an anti-slip lining to improve the engagement of the guard with the toe and heel plates (120, 123). The structure of the guide bar (11) and the block (12) are so selected that—with the undersides (19, 22) resting firmly on the support portions (18, 21)—the runner edge (15) of the blade of the skate is devoid of any contact with the guide bar whereby even a slightest dulling of the runner edge (15) is prevented. At the same time, the skate guard can be conveniently and quickly attached to or detached from a blade. In a preferred embodiment, the outer step-on surface of the guide bar is provided with an anti-slip sticker (114) to improve safety of the guard for walking on wet floor or the like.

24 Claims, 6 Drawing Sheets

SKATE GUARD

This invention relates to the improvement of skate guards of the type readily and conveniently attachable to or removable from the skate blade. More particularly, the invention relates to the type of skate guards where the edge of the runner of the blade is spaced above any portions of the guard so that the edge of the runner remains devoid of any contact with the guard to prevent even a slight dulling of the runner edge while walking around with the guard applied.

While no rigidly prescribed terminology exists in the art of skates, certain terms have been accepted by the industry and users and is also used throughout the present specification. In particular, "the skate" designates an arrangement comprised from a "skate blade" or "blade" and a "skate boot" to which the skate blade is fixedly secured. The term "skate blade" designates the product which generally comprises a "skate runner" or simply a "runner" combined with the toe plate and the heel plate. The two plates are compatible with the exterior of the sole of the skate boot and serve as securement flanges for holding the skate blade to the skate boot. The lowermost edge of the skate runner which slides over the ice surface when the skate is in use, is referred to as the "runner edge." It is usually defined by a longitudinal groove having a shallowly concave cross-section.

Skate guards of the type in which the edge of the runner of the blade is suspended above the floor and above any part of the guard or protector have been disclosed in numerous prior art references. Thus, U.S. Pat. No. 1,982,524 (Kutchera) discloses a combination of two adjustable parts which are arranged to match the size of a skate. The guard portions are arranged to support the toe plate and the heel plate of the blade and a strap wrapped around the instep is used to maintain the arrangement secured to the skate. The arrangement is complex in structure, cumbersome to use as it is inconvenient to attach or detach to the boot.

U.S. Pat. No. 2,137,637 (Jorgensen) presents another arrangement in which the skate guard is composed of a front and rear portion and attaches to the tubular members of the blade in which the runner is imbedded. Due to the rounded cross-section of the tubular member of the blade, the arrangement is not safe in securement of the guard to the blade. In extreme conditions, it may happen that the clips holding the protector to the skate may be forced apart to drop the edge of the runner to the bottom of the protector. Besides, two independent protectors are required for each skate. The problem with the reliability of the hold of the protector on the skate is probably the reason why there is one additional embodiment in which the blade rests on an elastic padding forming a part of the protector. Such arrangement, of course, is disadvantageous in that the runner edge of the blade may become dulled by contact with the elastic material.

U.S. Pat. No. 2,154,735 (Driscoll et al.) presents another arrangement in which the blade is held between two resiliently arranged holding plates adapted to envelope the tubular holder of the blade of the skate. The arrangement is composed of two parts held together by a channel shaped flat piece. Side plates of the front and of the rear piece rest against the toe plate and heel plate of the respective blade. This is a complex arrangement which, furthermore, does not have a reliable hold with the blade particularly in the toe plate region of the guard.

U.S. Pat. No. 2,181,779 (Barnard) presents a skate guard which is placed over the runner of the blade. It is held in place, at the rear end, by a forwardly and downwardly inclined end wall while the front end is provided with a clamping element which is adapted to be pivoted into and out of engagement with the blade. The blade edge contacts the bottom of the channel of the guard only at the back and at the front of the blade. This arrangement still requires that at least a part of the runner edge be in contact with the bottom of the channel of the skate guard thus potentially damaging or at least dulling the runner. Besides, the clamping member at the front of the skate guard is shown as being threaded into a bore provided in the body of the skate guard itself and is most likely highly unreliable.

U.S. Pat. No. 4,382,615 (Grönborg et al) presents another embodiment similar to that of the Jorgenson patent mentioned above, where the securement of the guard is effected by inserting the runner of the blade into slots provided in mounting plates forming a part of the guard. One of the disadvantages of this arrangement, viewed from the standpoint of the present invention, is its complex structure which requires adjustment of the length of the skate guard by manipulating two portions telescoped one in the other.

Finally, U.S. Pat. No. 4,392,674 (Evon) shows a skate guard which became very popular among professional skaters and which has the bottom part of the channel of the guard serrated such that the contact of the edge of the runner of the skate is minimized but is not completely avoided.

It is an object of the present invention to provide a skate guard having relatively simple structure yet providing an arrangement in which the sides of the runner of a skate blade, particularly a figure skating blade, are placed between laterally stabilizing sidewalls of a portion of a channel and wherein the runner edge of the blade is free of any contact with any parts of the skate guard which could potentially dull a part of the edge thus exposing the user to possible problems, for in competitive figure skating.

In general terms, the present invention provides a skate guard readily attachable to or detachable from a blade to enable walking, with the skate on, over a regular floor surface while protecting the runner edge of the blade of the skate, said skate guard comprising, in combination:

(a) an elongated guide bar;

(b) a first support portion projecting upwards from said guide bar and adapted to engage an underside portion of a toe plate of the blade, and a second support portion adapted to engage an underside portion of a heel plate of the blade, said support portions being arranged to suspend the blade of the skate such that the runner edge of the blade is generally devoid of a contact with the guard;

(c) a pair of skate clamping means secured to said guide bar one near each end of the bar and resiliently displaceable relative to each other in the direction of elongation of said guide bar, said clamping means being adapted to clamp therebetween a toe portion of the blade and a heel portion thereof so as to urge the blade in the direction toward said guide bar thus increasing engagement force between said support portions and said underside portions; and (d) laterally stabilizing side wall means adapted to engage portions of opposed sides of the blade to improve the stability of the guard against lateral tilt relative to the blade.

It is preferred that the first support portion, preferably the front end of the guard, be integral with the guide bar and the second support portion, preferably at the heel end of the guard, be a part of a support block slidable relative to the guide bar.

The skate guard is provided with skate clamping means, in the embodiment described a tension spring mechanism operatively associated with the heel support block. The clamping means is adapted to develop a clamping force holding the guard in firm engagement with the underside of the toe and heel plates of the blade. It will be appreciated, of course, that other types of the clamping means such as a ratchet mechanism may be used which would provide generally the same clamping effect.

The invention will now be described by way of a prototype and a preferred embodiment, with reference to the accompanying drawings.

Figure 1:
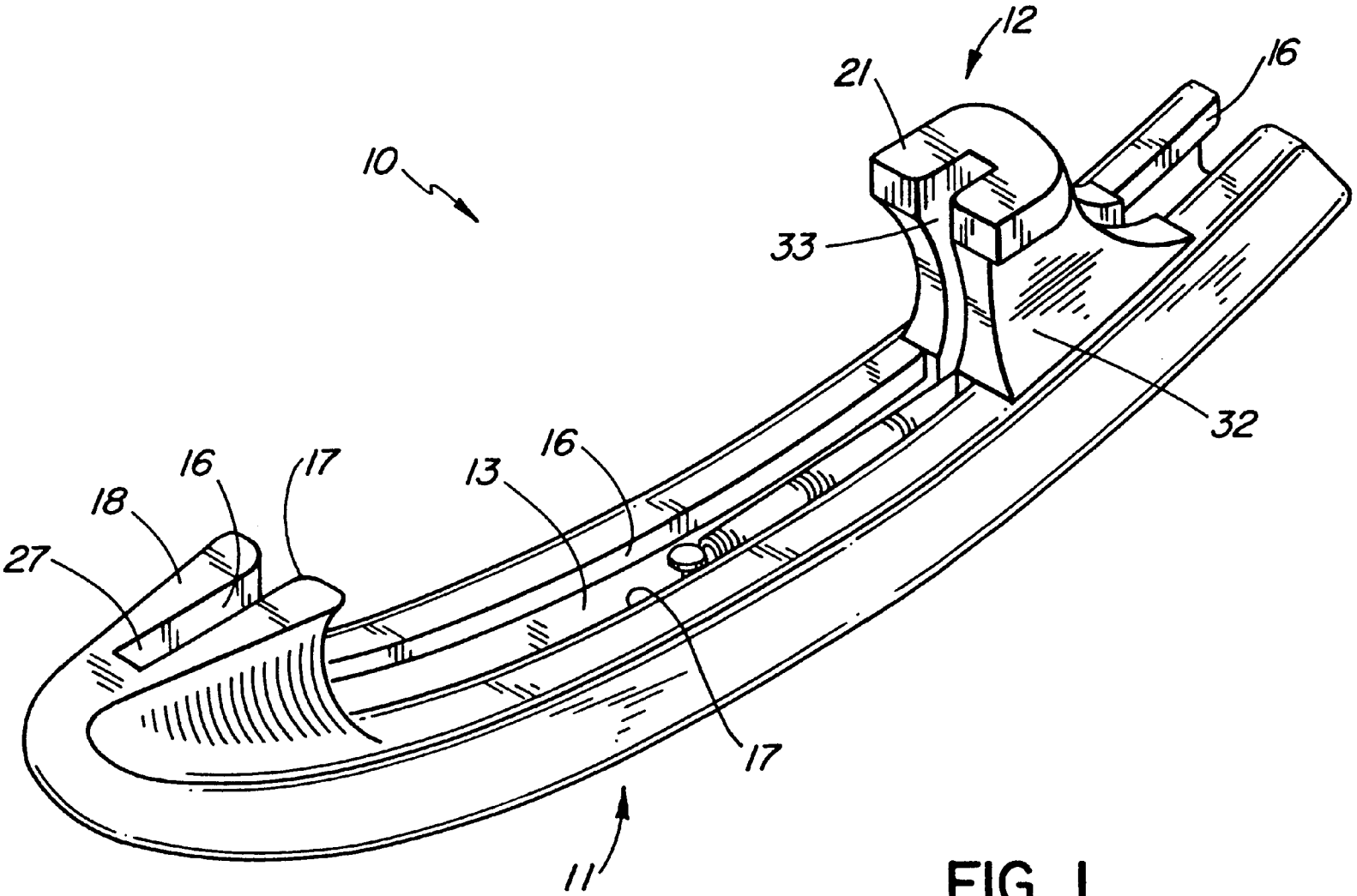
FIG. 1 is a top-side-and-front perspective view of the prototype.

With particular reference to FIG. 1, the reference number 10 denotes a skate guard of the type readily attachable to or detachable from a skate blade (see FIG. 4) to enable walking, with the skate on, over a regular floor while maintaining the runner edge of the blade of the skate protected.

The skate guard 10 is generally comprised of two sections movable relative to each other. The first section is referred to as a generally channel shaped longitudinal runner guide bar or protector 11. The second part of the guard is a support block 12. The guide bar 11 defines a centrally disposed upwardly open channels 13. The channel 13 extends the full length of the guide bar 11. The guide bar 11 and the block 12 are made from a rigid thermoplastic material, for instance from Nylon.

The underside of the bar 11 may be provided with a softer, rubbery material or with other anti-slip means to reduce the possibility of slipping on a wet tile floor or the like.

Figure 2:
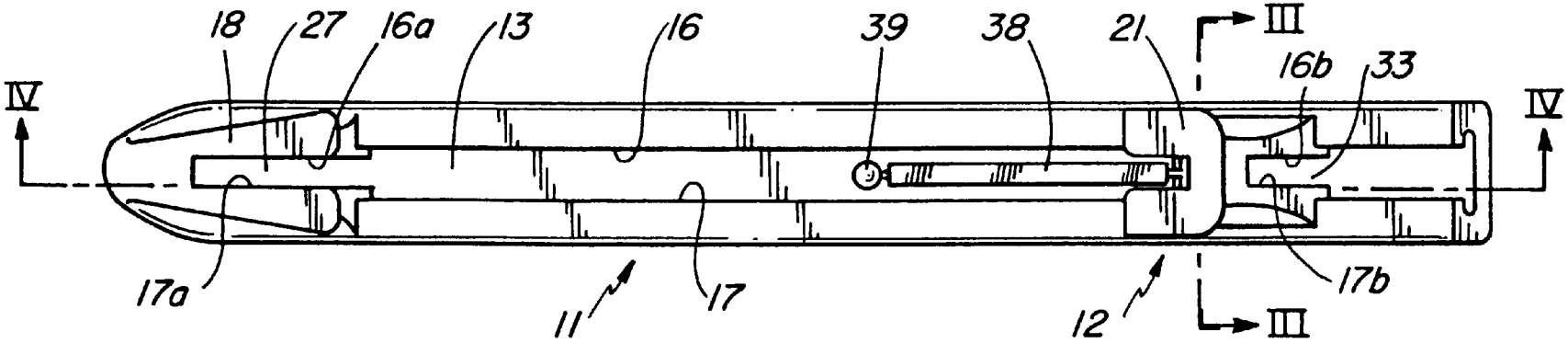
FIG. 2 is a top plan view of the skate guard shown in FIG. 1.
Figure 4:
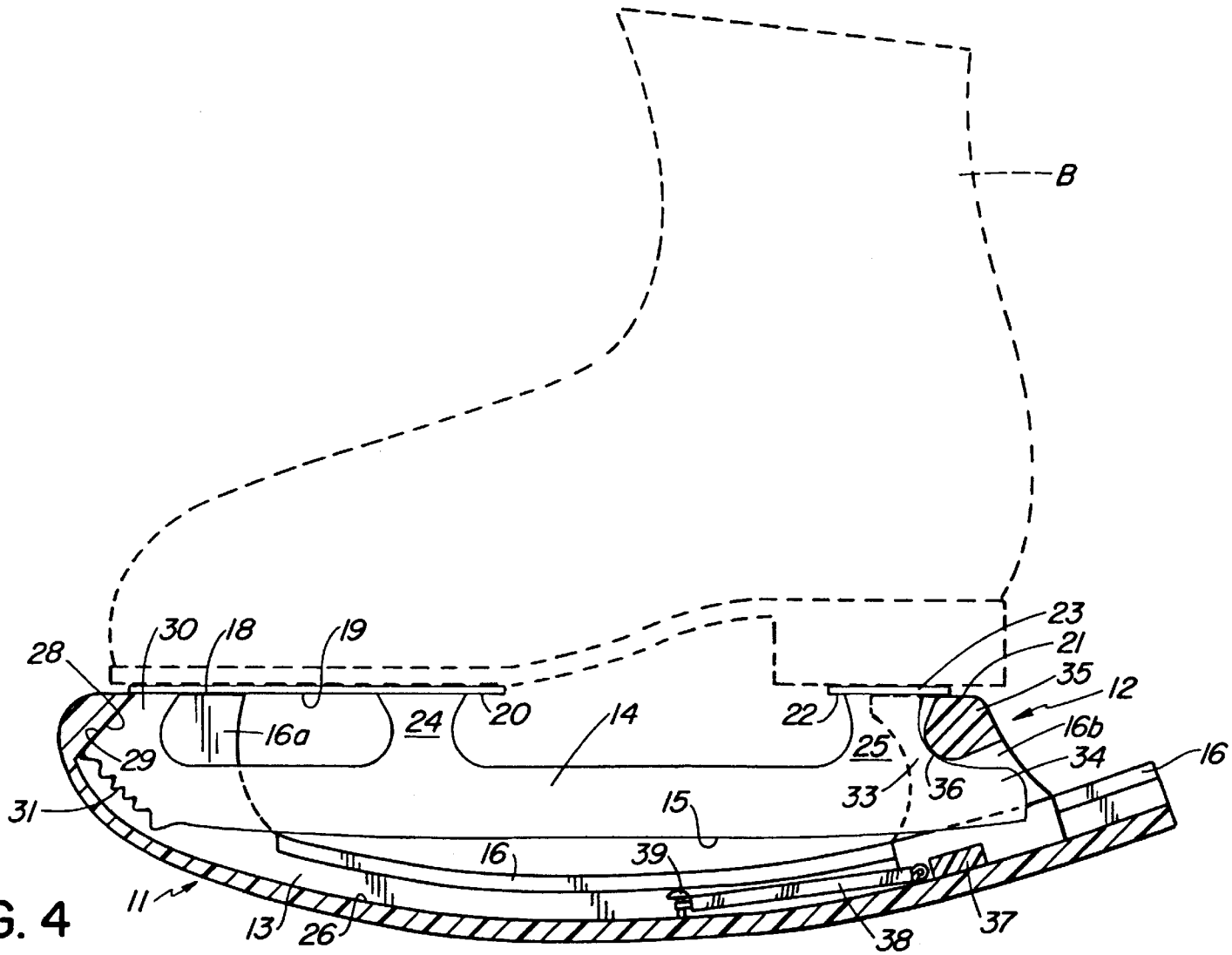
FIG. 4 is section IV—IV of FIG. 2.

As best seen from FIG. 4 but also looking at FIG. 2, the channel 13 merges, at the toe end of the guard, with a narrower portion which is also referred to as a "front groove" 27. The front groove section is typical in that its width, defined by a distance between side walls 16*a,* 17*a,* corresponding to the sides 16, 17, of the channel 13, is substantially smaller than that of the width of the groove 13. The width of the front groove 27 is designed to correspond to the thickness of a skate blade with which the skate guard is to be used, to permit convenient inserting of the skate blade 14 between the sides 16*a,* 17*a* while securing a reasonable resistance to a lateral tilt of the blade when the guard is applied. The side walls 16*a,* 17*a* thus form a first part of laterally stabilizing side wall sections adapted to engage portions of opposed sides of the blade to improve stability of the guard against lateral tilt relative to the blade.

It should be noted at this point that the support block 12 defines two opposed side walls 16*b,* 17*b* of what is referred to as a second channel section. The second channel section defined by walls 16*b,* 17*b* is typical in that (like the first section) its width, defined by a distance between side walls 16*a,* 17*a,* is aligned with the channel 13 but is substantially smaller than that of the groove. The width of the second channel section 33, also referred to as "a rear groove" like the front groove 27, is designed to correspond to the thickness of a skate runner 14 with which the skate guard is to be used, to permit convenient inserting of the skate runner 14 between the sides 16*b,* 17*b* while securing a reasonable resistance of the blade to a lateral tilt relative to the guard when the latter is in use. Thus, the side walls 16*b,* 17*b* form a second part of laterally stabilizing side wall sections adapted to engage portions of opposed sides of the runner to improve stability of the runner relative to the guard.

Thus, the sides of the runner 14 at the toe end are held within the front groove 27 and at the heel end in the front groove 33. The grooves 27, 33 are aligned with the guide groove or channel 13 and thus with each other. They provide an anti-tilting mechanism of the guard. As best seen in FIG. 4, a part of the runner edge 15 is disposed within the grooves 27, 33 and between their sidewalls 16*a,* 17*a;* 16*b,* 17*b.*

The front or toe end of the integral guide bar 11 where the front groove 27 is provided, defines on its top a generally planar, upwardly facing support portion 18 which is adapted to engage an underside portion 19 (FIG. 4) of the toe plate 20 of the blade.

The support block 12 defines a somewhat similar, generally planar upwardly facing support portion 21 which is adapted to engage the underside portion 22 of the heel plate 23 of the blade. As is well known, the toe plate 20 and the heel plate 23 are in effect mounting flanges serving the purpose of fixed securement of the blade to a skating boot B. Supporting columns 24, 25 of the blade project upwards from the runner 14 and are usually welded integral with the toe and heel plates 20, 23.

As can be appreciated upon review of FIG. 4, when the support portion 18 and the support portion 21 are in engagement with the underside of the toe and heel plates 19, 22, the runner edge 15 of the blade is suspended above the guide bar or protector 11 and above the bottom part of the front groove 27. The toe end of the runner edge 15 is also free of any contact with the guard at the support portion 18 near the toe end of the guard. Thus, the only parts of the runner 14 actually touching a portion of the skate guard are sections of the opposed side walls of the toe and heel portions of the runner. They are in a slight contact with respective opposed, laterally stabilizing side walls 16*a,* 17*a,* 16*b,* 17*b* of the front and rear grooves 27–33 to prevent lateral tilting of the guard relative to the skate during the walking with the guard on.

It can thus be appreciated that the skate guard shown in FIG. 4 not only protects the runner 14 in the usual fashion but also secures that there is generally no contact between the guard 10 and the underside or runner edge 15 of the blade.

The front groove 27 (FIG. 1) disposed centrally of the support portion 18 is in effect a continuation of the side walls 16, 17 of the channel 13.

The forwardmost part of the channel defined by the stabilizing walls 16*a,* 17*a,* defines a downwardly and rearwards directed first clamping surface 28 which, as best seen in FIG. 4, is compatible with the upwardly and rearwards inclined edge 29 of the toe portion 30 of the blade. The uppermost part of the toe portion 30, of course, is welded to the toe plate 20 as is well known in the art.

The skate shown in FIG. 4 being a figure skating skate, the lower edge 31 is provided with serrations which eventually merge with the smooth, sharpened runner edge 15.

The rear support portion 21 forms a part of the support block 12. The support block 12 defines the already mentioned rear groove 33 which partly envelopes the column 25 and the heel portion 34 of the blade. At the rear portion 34 of the runner 14, the rear groove 33 is traversed by a solid section 35 (FIG. 4) disposed transversely of the rear groove 33 and providing a downwardly and forwards facing second clamping surface 36.

The rear groove 33 is also discontinued at the bottom of the block 12 to define a transverse base 37 to which is anchored the rear end of a tension coil spring 38 disposed within the guide channel 13. The front end of the spring 38, on the other hand, is anchored to the blade protector 11 at 39 (FIG. 4).

Figure 3:
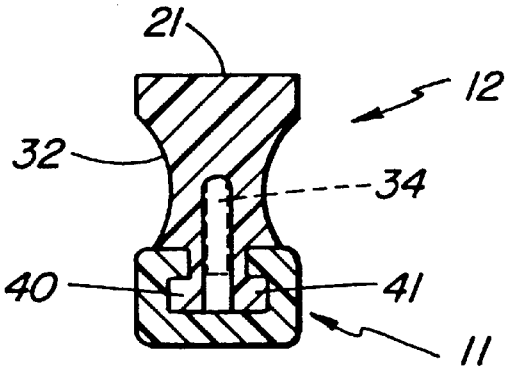
FIG. 3 is section III—III of FIG. 2.

With reference to FIG. 3, the blade protector or guide bar 11 of the embodiment shown defines an inverted T-shaped guide groove in which are slidably received flanges 40, 41 of the block 32. This provides for a sliding securement of the support block 12 to the guide bar 11. With the tension spring 38 arranged as shown, it will thus be appreciated that as long as the spring 38 is under a tension, it resiliently urges the block 21 towards the clamping surface 28. The strength selection and location of the spring 38 is such that, with the skate clamped between surfaces 28 and 36, there is still substantial tension present at the spring 38 so that there is a constant downward wedging force active at the runner 14 and thus on the entire blade. With the runner edge 15 spaced above the bottom 26 of the channel 13, this wedging pressure results in a firm engagement between the undersides 19, 22 of the toe and heel plates 20, 23, respectively. Thus, the prototype shown in the drawings is a representation of one embodiment of what can generally be referred to as "clamping means" (surfaces 28 and 36) resiliently displaceable (by spring 38) relative to each other in the direction of elongation of the channel 13 relative to each other. They are, of course, adapted to wedgingly clamp the toe portion 30 and the heel portion 34 of the runner 14 so as to urge the runner 14 in the direction inwardly of the channel.

The spring and its anchoring portions are, of course, one embodiment of what can generally be referred to as "drive means operatively associated with the support block 12 to releasably urge same into a clamping position". The clamping position of the embodiment shown is achieved by urging the block 12 forwards relative to the toe portion 18 of the protector 11. It will be appreciated that the releasable clamping force can be generated by other means, for instance by a ratchet mechanism acting on the support block 12.

When not attached to a blade, the block 32 is normally disposed somewhat forwards of the position shown in FIG. 4. This position is provided by a total contraction of the spring 38. When it is desired to apply the skate guard, the user simply holds the skate guard, engages the heel portion of the blade with the block 32 by inserting the heel portion 34 into the rear groove 33 thus engaging (in the embodiment shown), the clamping surface 36 with the joinder between the column 25 and heel portion 34 of the runner 14. The heel end portion of the blade is now engaged with the block, the sides of the runner 14 being the only portions of the blade engaging the guard at the side walls 16*b*, 17*b* of the second channel section. On a subsequent pulling of the blade protector 11 forwards, the block 32 is displaced rearwards of the position shown in FIG. 4 until the extreme tip of the toe portion 30 can be inserted into the front groove 27, between opposed stabilizing side walls 16*a*, 17*a* thereof. With the skate disposed within the stabilizing walls 16*a*, 17*a* of the front groove, the force of the spring 38 brings the block again forwards into a firm clamping engagement. The forward force active at the block 12 results in a downwardly directed wedging component which wedgingly urges the runner 14 towards the guide bar 11, that is, downwards, while a lateral tilt of the guard during the walking on a regular floor is prevented by the engagement described, between the sides of the runner 14 at the toe and heel ends with the side walls of the channel portion comprised of the grooves 27, 33.

It can thus be seen that the application of the skate guard to a blade is much the same as in the popular skate guards in which two halves are urged to each other by a spring (see U.S. Pat. No. 4,392,674 referred to above). To remove the skate guard, a reverse operation is effected by pulling the blade guide bar or protector 11 forwards until the forwardmost tip of the toe portion 30 of the blade is free to move out of the front groove 27 and above the support portion 18 and then simply moving the guide bar 11 rearwards to withdraw the heel portion 34 of the runner 14 out of the engagement between the stabilizing side walls 16*b*, 17*b* of the rear groove 33 in the support block 12.

Figure 5:
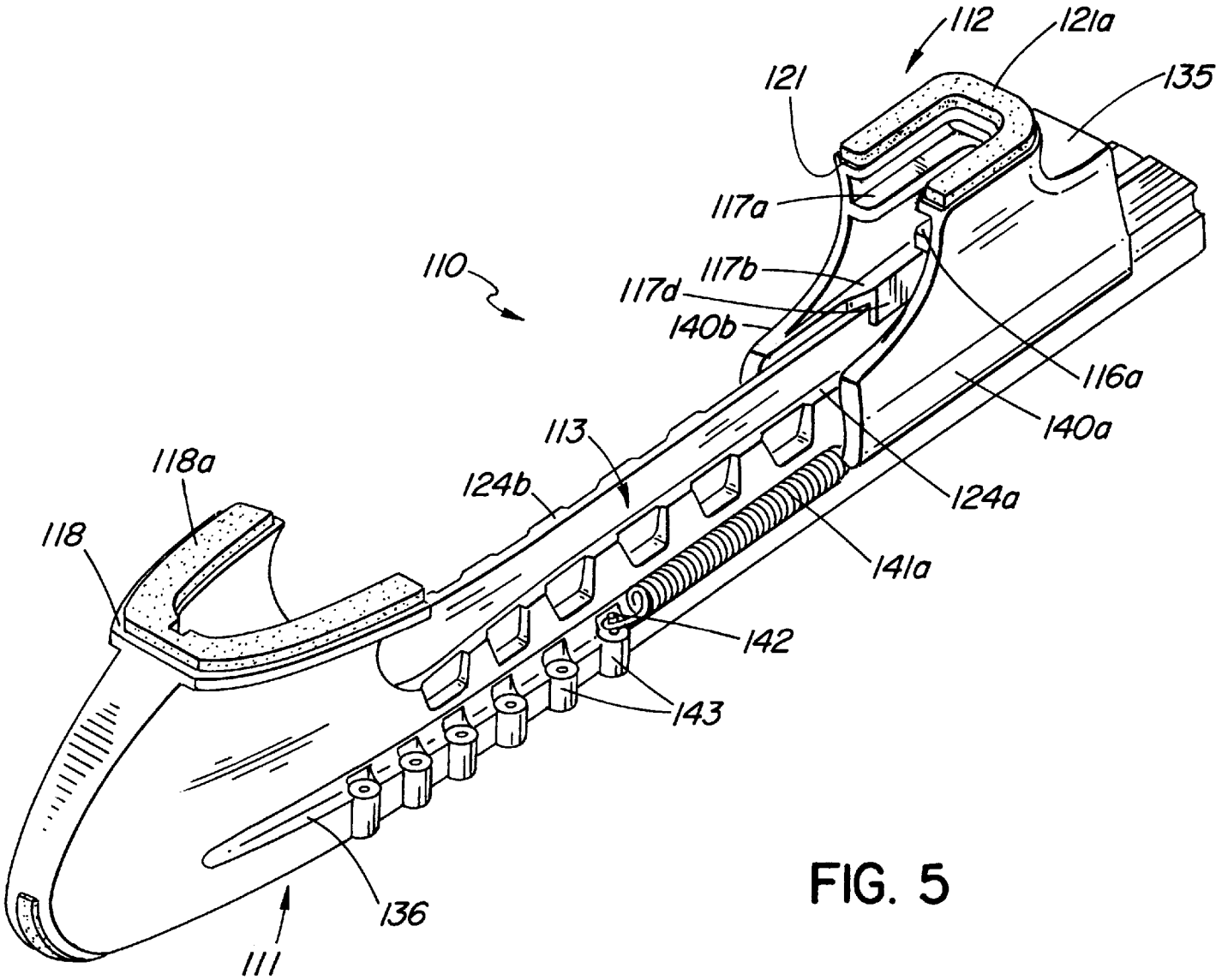
FIG. 5 is a top-side-and-front perspective view of the preferred embodiment.

A preferred embodiment of the present invention will now be described with reference to FIGS. 5–8. In FIG. 5, the reference number 110 denotes the preferred embodiment of the skate guard. As in the case of prototype, the skate guard 110 is readily attachable to or detachable from a skate blade (see FIG. 8) to enable walking, with the skate on, over a regular floor while maintaining the runner edge of the blade of the skate protected.

The skate guard 110 includes two sections movable relative to each other. The first section is referred to as a generally channel shaped longitudinal runner guide bar or protector 111 and the second part as a support block 112. The protector 111 and the block 112 are both made from a rigid thermoplastic material, for instance from Nylon. As in the first embodiment, the guide bar 111 defines a centrally disposed longitudinal guide groove 113 (FIG. 6).

The underside of the bar 111 is provided with an anti-slip sticker 114 covering generally the entire length of the bar 111 and reducing the danger of slipping on a wet tile floor or the like.

Figure 6:
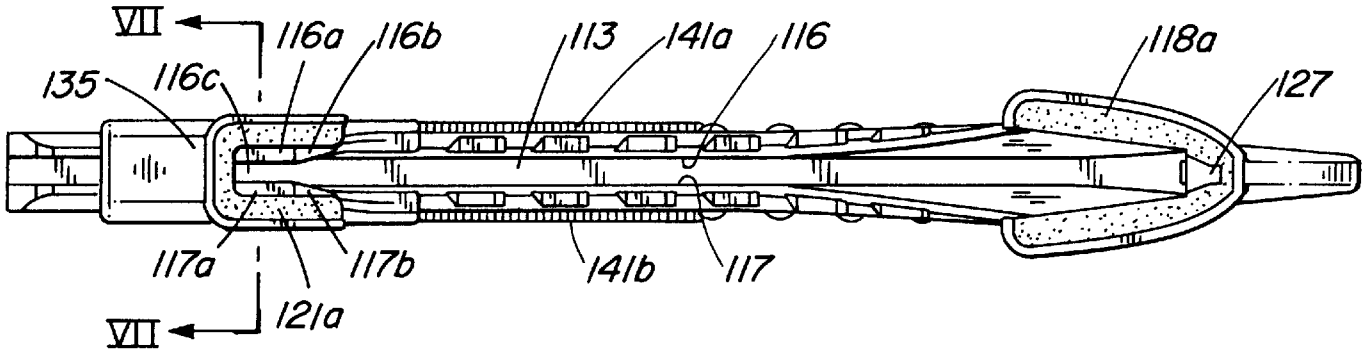
FIG. 6 is a top plan view of the skate guard shown in FIG. 5.
Figure 7:
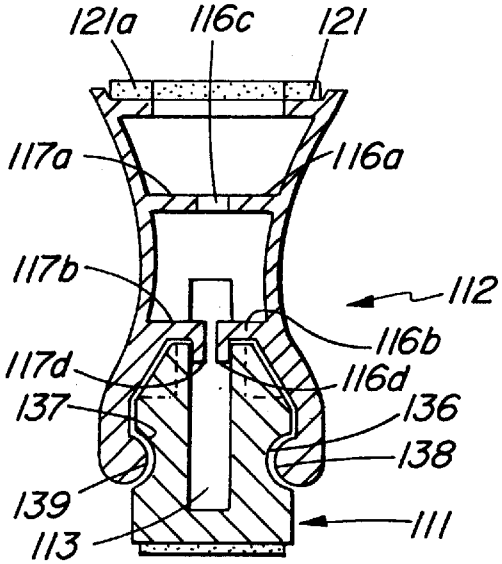
FIG. 7 is section VII—VII of FIG. 6.

With reference to FIG. 6 the groove 113 merges, at the toe end of the guard, with a downwardly and inwards narrowing portion which is the counterpart of the front groove 27 of the first embodiment and is therefore likewise referred to as a "front groove" 127. The first front groove 127 is typical in that its width is slightly narrower than the distance between the sides 116, 117 of the groove 113. The width of the front groove 127 is designed to correspond to the thickness of a skate blade with which the skate guard is to be used, to permit convenient inserting of the skate blade runner 116 between the sides 116, 117 while securing reasonable resistance to a lateral tilt of the blade when the guard is applied. Thus, like in the first embodiment, in the preferred version, the side walls of the front groove 127 defines what is generally referred to as a first part of laterally stabilizing side wall sections adapted to engage portions of opposed sides of the blade, particularly of the runner 115, to improve stability of the guard against lateral tilt relative to the blade.

As best shown in FIG. 5, the support block 112 of this embodiment defines two opposed upper lateral ribs 116*a*, 117*a* and a similarly arranged two opposed lower lateral ribs 116*b*, 117*b*. Only one lower lateral rib 117*b* is visible in FIG. 5. In FIG. 6 both forwardmost sections of the ribs 116*a*–117*a* are shown. The forwardmost sections of the ribs 116*b*–117*b* have their forwardmost parts divergent in a forward direction to facilitate the placement of the guard 110 over a skate blade.

The inner straight edges of the ribs 116*a*–117*a* are spaced apart a distance generally corresponding to the thickness of the blade with which the guard 110 is to be used. They thus present another embodiment of the rear groove 116*c* (FIG. 6), which is the functional equivalent of the rear groove 33 mentioned above as their inner edges are adapted to avoid or at least minimize lateral tilt between the skate blade and the guard 110 in generally the same way as that described with respect to the second channel section 33 of the first embodiment. The downwardly facing surfaces of the lower ribs 116*b,* 117*b* form gliding surfaces which are adapted to freely glide on upper edges 124*a,* 124*b* of side walls of the guide groove 113. The inside end of each of the lower ribs lateral ribs 116*b,* 117*b* is integrally formed with a downwardly turned, planar lip 116*d,* 117*d* (FIG. 7) each slidably engaging the respective side of the guide groove 113. The opposed inner faces of the lips 116*d,* 117*d* form a part of the rear groove 116*c.*

Accordingly, as in the first embodiment, the sides of the runner 115 at the toe end are held within the front groove section 127 and at the heel end in the rear groove 116*c.* The front and rear grooves 127, 116*c* are disposed longitudinally of the guide bar 111 and are co-axial with each other. They combine to provide an anti-tilting mechanism of the guard. The intermediate part or guide groove 113 is not effective in preventing the tilt due to its somewhat larger width best seen in FIG. 6. The grooves 127, 116*c* surround the front and rear portion of opposed sides of the runner 115 of the skate. The runner edge of the runner 115 is entirely within the longitudinal guide groove 113 as shown in FIG. 8.

The front or toe end of the integral guide bar 111 where the front groove 127 is provided, defines on its top a generally planar, upwardly facing surface 118 which is provided with an anti-slip layer 118*a* having a coarse upwardly directed surface and usually being of the type of an adhesive sticker secured to the surface 118 to define therewith a support portion adapted to engage an underside portion 119 (FIG. 8) of the toe plate 120 of the blade.

The support block 112 defines a somewhat similar, generally planar upwardly facing surface 121 provided with an anti-slip layer 121*a* so that the surface 121 and the layer 121*a* combine to provide a support portion which is adapted to engage the underside portion 122 of the heel plate 123 of the blade.

Figure 8:
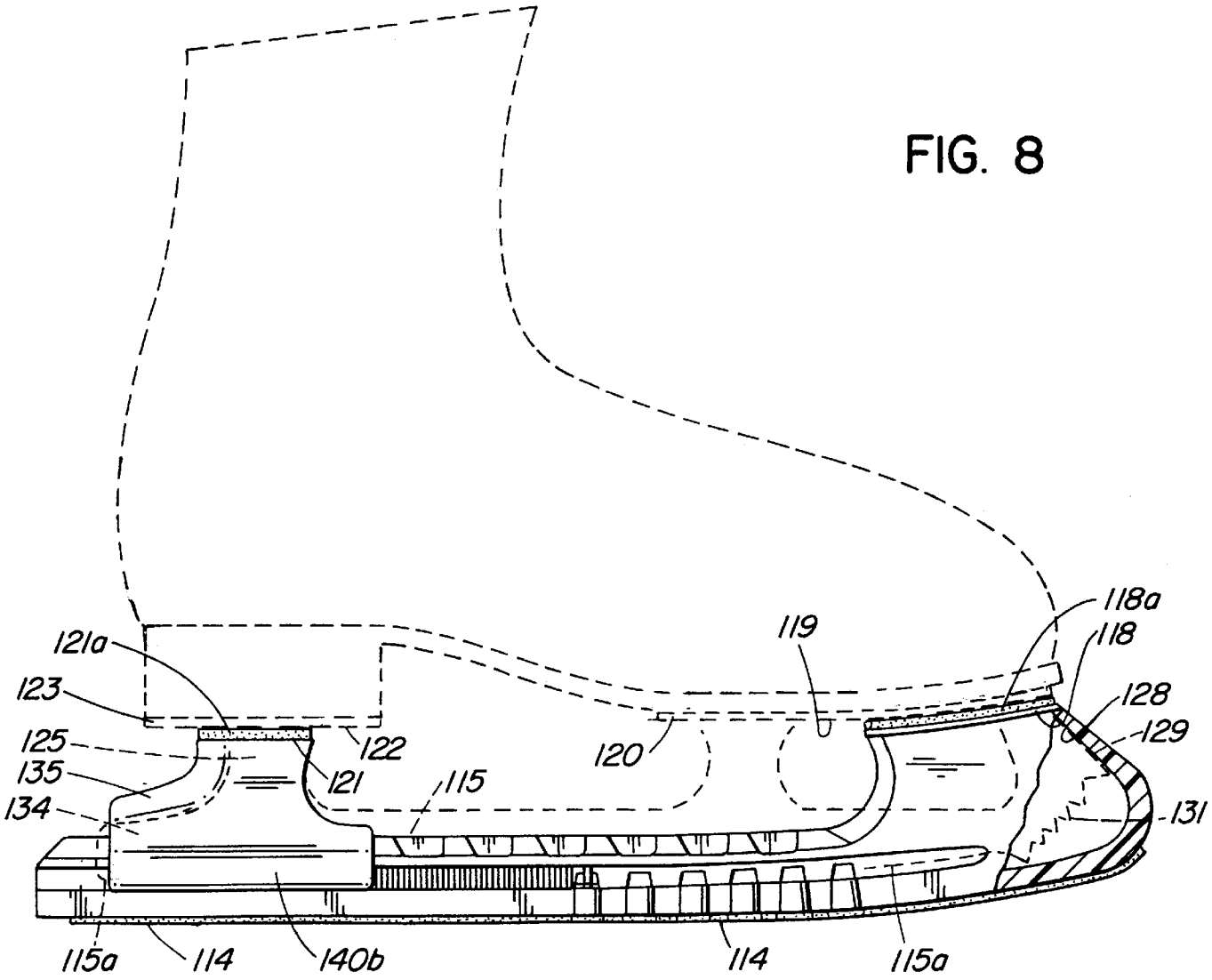
FIG. 8 is a side view, partly in section, of the guard shown in FIG. 5.

FIG. 8 shows that when the support portions 118–118*a* and 121–121*a* engaged with the underside of the toe and heel plates 120, 123, the runner edge 115*a* of the blade 115 is suspended above the bottom of the guide groove 113. Thus, as in the first embodiment, the only parts of the runner 115 actually touching a portion of the skate guard are the opposed side walls of the toe and heel portions of the runner to prevent lateral tilting as mentioned above. Thus the skate guard of the second embodiment provides the same advantages as that of the first embodiment in that it not only protects the runner 115 in the usual fashion (in the second embodiment the runner 115 is fully within the guide groove 113) but also secures that there is no contact between the bottom of the groove 113 and the underside or runner edge 115*a* of the blade.

The bottom of the front groove 127 defines, at a forwardmost part thereof, a downwardly and rearwards directed first clamping surface 128 which (FIG. 8) is compatible with the downwardly and forwards inclined toe edge 129 of the blade. The uppermost part of the toe portion of the blade is welded to the toe plate 120 as is well known in the art.

As in the first embodiment, the skate shown in broken lines of FIG. 8 is a figure skating skate where the lower toe edge 131 is provided with serrations which eventually merge with the smooth, sharpened runner edge 115*a.*

Turning now back to the structure of the support block 112, the inner edges of the inwardly projecting lateral ribs 116*a,* 117*a* of the block 112 define the rear groove 116*c* (FIG. 6) which partly envelopes the rear column 125 and the heel portion 134 of the blade. At the rear portion 134 of the runner 115, the rear portion of the support block 112 is traversed by a solid rear wall 135 defining an inside wall which is convex in a side view and is adapted to engage the concave edge portion between the rear column 125 and the rear portion 134 of the runner 115.

One of structural differences between the first and the second embodiment is in the structure of the resilient gliding arrangement of the support block 112 along the guide bar 111.

Each side of the guide bar 111 is provided with a rounded groove 136, 137 extending along a substantial length of the guide bar 111. Each groove is compatible in cross-section with an inwardly directed rounded lip 138, 139 of the support block 112. The length of each lip 138, 139 is generally equal to the length of the lowermost portion of the respective side wall 140*a,* 140*b* of the block 112. As the length of the side walls 140*a,* 140*b* extends a substantial distance forwardly and rearwards of the column of the block 112, a smooth guiding is provided for the gliding of the block 112 along the guide bar 111. The guiding of the block 112 is further aided by the ribs 116*b,* 117*b* and by their downwardly turned lips 116*d,* 117*d* as described above. One of the effects of the downwardly turned lips 116*d,* 117*d* is that they reinforce the lower part of the block. Since they engage the side walls of the guide groove 113 of the guide bar 111, they act against the tendency of the rounded lips 138, 139 to spread apart due to the weight applied at the surface 121, or to an upward force which may occur when the user walks with the guard on.

Anchored to the front end of each of the side walls 140*a,* 140*b* is a tension spring 141*a,* 141*b* each of which is partly enveloped by the respective channel 136, 137. The opposite, forward end of each spring 141*a* (FIG. 5) is anchored to a threaded pin 142 engaged in a vertical passage of one of a plurality of cylindric projections 143. Thus, the tension of the spring such as spring 141*a* can be adjusted by selecting an appropriate projection 143 for anchoring the forward end of the spring 141*a.*

The application or removal of the guard of the second embodiment involves a technique generally identical with that described in connection with the first embodiment. When the guard 110 is not attached to a blade, the block 112 is disposed somewhat forwards of the position shown in FIG. 8. This position is provided by a total contraction of the springs 141*a,* 141*b.* When it is desired to apply the skate guard 110 to a skate blade, the user simply holds the skate guard, engages the heel portion of the blade with the block by inserting the heel portion of the blade into the cavity of the block 112 (the cavity best shown in FIG. 5). Then the guide bar 111 is pulled over the toe end of the runner much in the fashion described in connection with the first embodiment.

Those skilled in the art will readily appreciate that the prototype and the preferred embodiment disclosed can be modified to a greater or lesser degree without departing from the gist of the present invention. As a few examples only, the drive mechanism of a tension spring or springs can be replaced with another mechanism, the structure of the guiding mechanism of the support block 112 can be modified. The lateral tilt of the guard can also be prevented by many other, readily conceivable structures of side sections engaging the blade. The term "generally devoid of" referring to the isolation of the runner edge from a contact with the guard is to be interpreted as leaving virtually the entire length of the runner edge spaced from the guard, as opposed, for instance, to the limited but still substantial contact shown in the Evon patent referred to above.

Accordingly, we wish to protect by Letters Patent which may issue on this application all such embodiments as fairly fall within the scope of our contribution to the art.

I claim:

1. A skate guard readily attachable to or detachable from a blade of a skate to enable walking, with the skate on, over a regular floor surface while protecting a runner edge of the blade of the skate, said skate guard comprising, in combination:

(a) an elongated guide bar;

(b) a first support portion projecting upwards from said guide bar and adapted to engage an underside portion of a toe plate of the blade, (c) a second support portion projecting upwards from said guide bar and adapted to engage an underside portion of a heel plate of the blade, (d) said support portions being arranged to suspend the blade of the skate such that the runner edge of the blade is generally devoid of a contact with the guard; and (e) a pair of skate clamping means secured to said guide bar one near each end of the bar and displaceable relative to each other in the direction of elongation of said guide bar, said clamping means being adapted to clamp therebetween a toe portion of the blade and a heel portion thereof so as to urge the blade in the direction toward said guide bar thus increasing the engagement force between said support portions and said underside portions.

2. The skate guard of claim 1, further comprising laterally stabilizing side sections adapted to engage opposed sideways turned portions of the blade to improve the stability of the guard against lateral tilt relative to the blade.

3. The skate guard of claim 2 wherein said first support portion is integrally formed with the guide bar and said second support portion is an upper surface of a support block longitudinally movable relative to the guide bar.

4. The skate guard of claim 3 further comprising a drive mechanism operatively associated with said support block to releasably urge same to a clamping position.

5. The skate guard of claim 4, wherein the drive mechanism is an elastic drive mechanism arranged to urge the block toward the first support portion.

6. The skate guard of claim 2 wherein said clamping means includes (a) an oblique first clamping surface portion facing downwardly towards the guide bar and rearwards of the guard member; and (b) an oblique second clamping surface portion facing downwardly towards the guide bar and forward of said guard member.

7. The skate guard of claim 6 wherein said first clamping surface portion is integrally formed with the guide bar and said second clamping surface is integral with a support block slidable relative to the guide bar.

8. The skate guard of claim 7 further comprising a drive mechanism operatively associated with said support block to wedgingly urge the same to a clamping position.

9. The skate guard of claim 8, wherein the drive mechanism is a drive mechanism arranged to urge the block toward the first clamping surface.

10. The skate guard of claim 7 wherein the first clamping surface portion is compatible with a generally upwards and rearwards facing toe end portion of the blade and the second clamping surface portion is compatible with a generally upwards and forward facing heel end portion of the blade.

11. A skate guard readily attachable to or detachable from a blade of a skate to enable walking, with the skate on, over a regular floor surface while protecting a runner edge of the blade, said skate guard comprising, in combination:

(a) an elongated guide bar;

(b) a first support portion projecting upwardly from and integrally formed with the guide bar, said first support portion engaging an underside portion of a toe plate of the blade;

(c) a second support portion projecting upwardly from said guide bar and integrally formed with a support block secured to said guide bar for sliding movement along the same, said second support portion engaging an underside portion of a heel plate of the skate;

(d) said first and second support portions suspending the blade of the skate such that a runner edge of the blade is generally free of a contact with the guard;

(e) a pair of skate clamping means secured to said guide bar one at each end thereof, said clamping means being resiliently displaceable relative to each other in the direction of elongation of said guide bar, and engaging, respectively, a toe portion of the blade and a heel portion thereof so as to urge the blade in the direction downwardly toward the guide bar to provide an engagement force between said support portions and said underside portions;

(f) laterally stabilizing side wall sections engaging opposed sideways turned portions of the blade to improve the stability of the guard against lateral tilt relative to the blade; and (g) drive means operatively associated with said support block to releasably urge the same toward the first support portion into a clamping position.

12. The skate guard of claim 11 wherein said first clamping surface portion is integrally formed with the guide bar and said second clamping surface is integral with said support block.

13. The skate guard of claim 11 wherein the first clamping surface portion is compatible with a generally upwards and forward facing toe end portion of the blade, and the second clamping surface portion is compatible with a generally upwards and rearward facing heel end portion of the blade.

14. The skate guard of claim 11 wherein the drive means is a tension coil spring disposed in said channel, a first end of the coil spring being anchored to the guide bar, a second end of the coil spring being anchored to said block.

15. A skate guard readily attachable to or detachable from a blade of a skate to enable walking, with the skate on, over a regular floor surface while protecting the runner edge of the blade of the skate, said skate guard comprising, in combination:

(a) an elongated guide bar defining an upwardly open longitudinal channel;

(b) a first support portion projecting upwardly from said guide bar and adapted to engage an underside portion of a toe plate of the blade, and a second support portion projecting upwardly from said guide bar and adapted to engage an underside portion of a heel plate of the blade, said support portions being arranged to suspend the skate with the runner of the blade disposed in said channel but with the runner edge spaced above a bottom section of the channel;

(c) a pair of skate clamping means secured to said guide bar and releasably displaceable relative to each other in the direction of elongation of said guide bar, said clamping means being adapted to clamp therebetween a toe portion of the blade and a heel portion thereof so as to urge the blade into said channel, thus increasing the engagement force between said support portions and said underside portions;

(d) said clamping means including (i) an oblique first clamping surface portion facing towards said channel and rearward of said guard member, and (ii) an oblique second clamping surface portion facing towards said channel and forward of said guard member; and (e) laterally stabilizing side wall sections adapted to engage sideways turned portions of the blade to improve the stability of the guard against lateral tilt of the guard relative to the blade.

16. The skate guard of claim 15 wherein said first clamping surface portion is integrally formed with the guide bar and with said first support portion, and said second clamping surface is integrally formed with a support block secured to the guide bar for sliding along the same and defining said second support portion.

17. The skate guard of claim 16 further comprising drive means operatively associated with said support block to releasably urge the same to a clamping position.

18. The skate guard of claim 17, wherein the drive means is arranged to elastically urge the block toward the first clamping surface.

19. The skate guard of claim 15 wherein the first clamping surface portion is compatible with an upward and forward facing to end portion of the skate blade and the second clamping surface portion is compatible with an upward and rearward facing heel end portion of the skate blade.

20. The skate guard of claim 17 wherein the drive means is a tension coil spring disposed in said channel, a first end of the coil spring being anchored to the guide bar, a second end of the coil spring being anchored to said block, whereby the spring resiliently urges the block toward the first support portion.

21. The skate guard of claim 17 wherein the drive means is a pair of tension coil springs, one at each side of the guide bar, a first end of each coil spring being anchored to the guide bar, a second end of each coil spring being anchored to said block, whereby the springs resiliently urge the block toward the first support portion.

22. The skate guard of claim 11 wherein said clamping means includes (a) a generally oblique first clamping surface portion facing downwardly toward the guide bar and rearward of the guard member; and (b) a generally oblique second clamping surface portion facing downwardly toward the guide bar and forward of said guard member.

23. The skate guard of claim 15, wherein said laterally stabilizing side wall sections are side walls of:

(a) a front groove provided in said first support portion; and (b) a rear groove provided in said support block.

24. The skate guard of claim 11, wherein said laterally stabilizing side wall sections are side walls of:

(a) a front groove provided in said first support portion; and (b) a rear groove provided in said support block.

* * * * *

UNITED STATES PATENT AND TRADEMARK OFFICE

CERTIFICATE OF CORRECTION

PATENT NO. : 5,941,568

DATED : August 24, 1999

INVENTOR(S) : Harry Harold White II

It is certified that error appears in the above-identified patent and that said Letters Patent is hereby corrected as shown below:

On the title page: Item [73] Assignee:

should read -- Marc Evon Enterprises, Inc., Windsor, Canada--.

Signed and Sealed this

Seventh Day of November, 2000

*Attest:*

Q. TODD DICKINSON

*Attesting Officer*

*Director of Patents and Trademarks*